US010221561B2

(12) United States Patent
Siller

(10) Patent No.: US 10,221,561 B2
(45) Date of Patent: Mar. 5, 2019

(54) FIRE OR SMOKE PROTECTION CURTAIN

(71) Applicant: Stoebich Brandschutz GmbH, Goslar (DE)

(72) Inventor: Stefan Siller, Lutter am Barenberge (DE)

(73) Assignee: STOEBICH BRANDSCHUTZ GMBH, Goslar (DE)

( * ) Notice: Subject to any disclaimer, the term of this patent is extended or adjusted under 35 U.S.C. 154(b) by 0 days.

(21) Appl. No.: 15/245,698

(22) Filed: Aug. 24, 2016

(65) Prior Publication Data

US 2017/0058513 A1 Mar. 2, 2017

(30) Foreign Application Priority Data

Aug. 28, 2015 (DE) ..... 10 2015 114 388

(51) Int. Cl.
*E04B 1/94* (2006.01)
*A62C 2/10* (2006.01)
(Continued)

(52) U.S. Cl.
CPC ..... *E04B 1/947* (2013.01); *A62C 2/10* (2013.01); *A62C 3/14* (2013.01); *E04B 1/946* (2013.01); *E04B 1/948* (2013.01); *E05D 15/00* (2013.01); *E06B 5/164* (2013.01); *E06B 9/581* (2013.01); *E06B 9/68* (2013.01); *E06B 2009/6836* (2013.01)

(58) Field of Classification Search
CPC .. E06B 9/581; E06B 2009/585; B60J 7/0015; B60J 1/2052; E05D 15/165
See application file for complete search history.

(56) References Cited

U.S. PATENT DOCUMENTS 1,882,982 A * 10/1932 Schmiedeskamp ..... E06B 9/581 160/273.1
4,649,981 A * 3/1987 Bibeau ..... E06B 9/581 160/120

(Continued)

FOREIGN PATENT DOCUMENTS

DE 299 22 593 U1 4/2000
DE 10 2005 040 758 A1 3/2007

(Continued)

*Primary Examiner* — Brian E Glessner
*Assistant Examiner* — Daniel Kenny
(74) *Attorney, Agent, or Firm* — W&C IP

(57) ABSTRACT

A fire or smoke protection curtain includes a textile fire protection element, which has a first side in the form of a front side and a second side in the form of a reverse side. The textile fire protection element can be put into a compact bearing arrangement and in a protection arrangement in which it counteracts the spread of a fire and/or smoke and while extending along a closing surface. At least one guide track guides the fire protection element while it is in the protection arrangement. The at least one guide track is designed to exert a holding force ($F_H$) that counteracts a bulging of the fire protection element. The at least one guide track is designed to exert the holding force ($F_H$) on the fire protection element to at least 80% from only one of the sides.

19 Claims, 8 Drawing Sheets

(51) Int. Cl.

| | |
|---|---|
| ***E06B 9/58*** | (2006.01) |
| ***A62C 2/06*** | (2006.01) |
| ***E05D 15/00*** | (2006.01) |
| ***E06B 5/16*** | (2006.01) |
| ***E06B 9/68*** | (2006.01) |

(56) References Cited

U.S. PATENT DOCUMENTS 5,570,544 A * 11/1996 Hale ..... E04H 15/20 52/2.11
6,068,040 A * 5/2000 Magro ..... E06B 9/581 160/133
6,176,039 B1 * 1/2001 Craig ..... E05F 15/43 49/197
6,374,543 B1 * 4/2002 Bishai ..... E05F 15/684 49/197
7,413,000 B2 * 8/2008 Lin ..... B60J 1/2025 160/265
8,016,014 B2 * 9/2011 Crider ..... E06B 7/16 160/201
8,851,147 B2 * 10/2014 Drifka ..... E06B 9/13 160/268.1
8,887,790 B2 * 11/2014 Drifka ..... E06B 9/13 160/268.1
9,187,953 B2 * 11/2015 Drifka ..... E06B 9/13
9,493,984 B2 * 11/2016 Casey ..... E06B 9/581
2009/0165964 A1 7/2009 Harbison
2009/0199978 A1 8/2009 Crider et al.
2014/0190097 A1 7/2014 Drifka et al.

FOREIGN PATENT DOCUMENTS

DE 10 2010 027555 A1 1/2012
FR 3004117 A1 10/2014
TW M494 007 U 1/2015
WO 2005/086893 A2 9/2005

* cited by examiner

FIRE OR SMOKE PROTECTION CURTAIN

FIELD OF THE INVENTION

The invention relates to a fire or smoke protection curtain with (a) a textile fire protection element which has a first side in the form of a front side and a second side in the form of a reverse side, which can be put in a compact bearing arrangement and a protection arrangement, in which it counteracts the spread of a fire and/or smoke, and which extends along a closing surface, and (b) at least one guide track that guides the fire protection element when the fire protection element is in the protection arrangement and that is designed to exert a holding force which counteracts a bulging of the fire protection element.

BACKGROUND

Fire or smoke protection curtains are used to delay the spread of smoke and/or a fire. Fire or smoke protection curtains are often used to seal an opening in a wall in the event of a fire. Should a compressed air difference emerge between the front side and the reverse side of the fire protection element, the at least one guide track must exert a holding force. The reverse side is, for example, the wall side of the fire protection element. Hence the holding force counteracts an excessive bulging of the fire protection element.

It is known to guide the fire protection element in a slot in the guide track and to arrange piping on the edges of the fire protection element, which prevents the fire protection element from slipping out of the slot and which leads to the fire protection element bracing itself on the edges of the slot, thereby resulting in the exertion of the holding force. Crimped metal objects may also be used in place of piping.

The disadvantage of solutions of the prior art is that the guide tracks must be built to be comparatively large. This is particularly disadvantageous if the guide track must be fixed to the soffit as, in this case, the guide track must either be inserted into the soffit, which is labour-intensive, or the clear width of the opening is reduced.

FR 3 004 117 describes a fire or smoke protection curtain that is arranged in front of a door and that utilises a ballast strip on the footer of the fire protection element in order to pull the fire protection element down in front of the door in the event of a fire. The bottom bar and the fire protection element run in an S-shaped moulded guide track. A disadvantage of this type of fire or smoke protection curtain is that it can only be used with a structure that absorbs normal forces, such as a door, and it is not smoke-proof.

US 2014/0190097 describes a curtain for wind-tight closure which is designed in such a way that the curtain element slips out of the guide rails if a critical wind load is exceeded. A reaction such as this is unacceptable with a fire or smoke protection curtain as it contradicts its protective function.

SUMMARY

The invention aims to reduce the disadvantages of the prior art.

The invention solves the problem by means of a fire or smoke protection curtain with a guide track designed to exert the holding force on the fire protection element from only one of the sides.

An advantage of the invention is that the guide track can be designed to be very compact, i.e. space-saving. If one looks along the closing surface with guide tracks according to the prior art, the guide track extends across both the first side and the second side of the fire protection element. However, a guide track of the fire or smoke protection curtain according to the invention need only extend over one side of the fire protection element. In other words, if one looks along the fire protection element, with guide tracks that comply with the prior art, a part of the guide track must be visible on both sides of the fire protection element at all times; with a guide track according to the invention, a part of the guide track must only be visible on one side of the fire resistant material. However, it should also be noted that it is possible for the fire or smoke protection curtain to have more than one guide track. In particular, it is advantageous that the guide track can be built to be flat. The holding force is preferably exerted on the fire protection element from the side facing the wall.

In addition, it is advantageous that a guide track according to the invention is particularly simple to produce. It is indeed advantageous and represents a preferred embodiment that the guide track comprises a piping bar, however this not necessary. A fire or smoke protection curtain according to the invention is thus also easy to install.

It is especially beneficial that the special guide track design allows for the closing to be easily monitored by means of a light grid. Light grids are made up of a number of light beams located at a distance from one another. An interruption of at least one of the light beams is recorded by an interruption recording device that, according to an embodiment of the invention, is part of the fire or smoke protection curtain and comprises a light grid generation device for generating the light grid. This ensures that the fire protection element can be brought to a stop by moving it into the protection arrangement if a foreign object, such as a person, is situated in the area of the closing surfaces. In order to securely record this foreign object on the one hand and, on the other hand, to avoid a false alarm, the distance between the closing surface and the light grid must be as small as possible. With known guide tracks this is only possible at considerable expense. Due to the fact that the guide track according to the invention only has to exert the holding force on the fire protection element from one side, the light grid generation device can be mounted very close to the closing surface.

In particular, the textile fire protection element is diverted onto the guide track from out of the closing plane. The resulting change in direction and the associated change in load direction allow for constructively smaller holding elements and/or thinner piping bars. In addition, the guide track can be created with smaller dimensions than those of current models. In comparison with current guide tracks, a guide track with smaller dimensions is more rigid and less susceptible to distortion in the event of a fire, as well as saving on material and space. The change in direction also results in a consistent and reliable sealing on at least one (generally two) of the edges of the guide track, rendering the construction smoke-proof without requiring an additional sealing system.

Within the scope of the present description, a fire or smoke protection curtain should be especially understood to mean any device that is designed to prevent or reduce the spread of fires and/or smoke, or to obstruct it for a long period of time, or to prevent the spread of smoke produced by a fire. In particular, the fire or smoke protection curtain is designed to withstand a fire for at least 30 minutes, in particular at least 60 minutes, preferably for at least 90 minutes. This test is conducted especially according to EN 1634-3. A fire or smoke protection curtain is therefore fundamentally different from devices that are only suitable for sealing openings.

In the event of a fire, fire or smoke protection curtains are exposed to high temperatures. This causes the components, especially the guide track or the guide tracks, to warp. In addition, the pressure difference acts on the fire protection element. It must be ensured that the guide track still holds the fire protection element securely, despite the high temperature and large acting force. With guide tracks according to the prior art, this is achieved by means of a large material thickness; however, this results in bulky guide tracks. The guide track illustrated in this description fulfils this requirement for fire resistance and is still flatter than known guide tracks.

The term textile fire protection element should be particularly understood to mean a fire protection element that comprises a fire resistant material. It is possible, but not necessary, that the fire resistant material also contains non-textile components, such as a lamination and/or a coating made of a cooling material.

The term fire resistant material should be especially understood to mean a fabric, scrim or knitted fabric that is not flammable and withstands thermal loads for a sufficiently long time to withstand an entrance of flames and/or smoke, especially for at least 30 minutes according to DIN EN 13501-2 and 3. The advantage of using fire resistant materials is the little effort required to produce them. This means it is possible to make the fire protection element out of one, two, three or more flat pieces of fire resistant material by connecting them, especially by sewing them together.

The term bearing arrangement should be particularly understood to mean the arrangement of the fire protection element in which the fire protection element leaves an opening, such as in a wall, unsealed. For example, when in the bearing arrangement, the fire protection element is rolled or gathered up on a winding shaft.

The term guide track should be especially understood to mean a device that counteracts a movement of the fire protection element in a direction perpendicular to the closing surface. It is possible and represents a preferred embodiment that the fire protection element is guided in every lateral edge. It is possible, but not necessary, that the fire or smoke protection curtain comprises two or more separate textile fire protection elements, which are each guided in their own guide tracks. The fire or smoke protection curtain preferably has guide tracks that are arranged on both sides of the fire protection element. In this way, the fire or smoke protection curtain can have a guide track on both the left side and the right side of the fire protection element.

In particular, the at least one guide track absorbs the total force that is necessary to counteract a bulging. In other words, the fire or smoke protection curtain is designed to seal an opening, for example in a building, and only the fire protection element seals the opening.

The feature that the guide track is designed to exert the holding force should be especially understood to mean that the holding force has a tightening effect on the fire protection element. This is particularly true if the fire protection element bulges. The holding force therefore acts on the fire protection element in the tangential direction, at least primarily, and not in the normal direction; the feature that the holding force primarily acts on the fire protection element in the tangential direction should be particularly understood to mean that a potential present normal force component of the holding force has a maximum value of 0.9 times that of the tangential component of the holding force. In other words, the holding force is a pulling force on the fire protection element.

In particular, the guide track is designed in such a way that, regardless of the direction in which the fire protection element bulges, it always exerts the holding force on the fire protection element from the same of the two sides.

The feature that the guide track is designed to exert the holding force on the fire protection element from only one side should be especially understood to mean that the holding force is exerted at least predominantly, in particular at least 80%, preferably at least 90%, by a part of the guide track that is either arranged only in the half-space to which the reverse side belongs, or only in the half-space to which the reverse side of the fire protection element belongs. In other words, the fire protection element splits the space into two separate half-spaces that are separated from one another by the fire protection element.

In particular, all force application points of forces that are exerted on the guide track by the fire protection element, when a tractive force is acting on the fire protection element, are located in only one of these half-spaces. In other words, a tractive force that is acting on the fire protection element and thereby acts on the closing surface causes only those parts of the guide track situated in one of the half-spaces to move in the direction of the tractive force. Other parts of the guide track can indeed move, but this movement does not go in the direction of the tractive force.

The closing surface should be understood to mean the mathematical surface that runs through the fire protection element when in the protection arrangement if there is no pressure difference acting on the fire protection element. According to a preferred embodiment, the closing surface refers to a simply curved surface, preferably one plane, which is then referred to as the closing plane. A simply curved surface can be described as comprising a multitude of parallel straight lines.

The term holding force should be understood to mean a force that acts in the closing surface. It is possible and, according to a preferred embodiment, intended that, alongside the holding force, the guide track exerts one or several other forces on the fire protection element. For example, the guide track is preferably constructed in such a way that it prevents a flapping motion of the outer edge of the fire protection element so that the edge of the fire protection element cannot slip out of the guide track.

According to a preferred embodiment, the guide track comprises a slot in which the fire protection element is guided when the fire protection element is in the protection arrangement, the slot being restricted on one side by a support edge and arranged in relation to the fire protection element such that the holding force is at least predominantly absorbed by the support edge. The advantage of this is that the force that counteracts the holding force—this counteracting force being exerted on the support edge by the fire protection element—can be easily absorbed. The support edge is preferably arranged on a support plate. The reaction force to the holding force then acts on the narrow side of the support plate. This renders the support plate very stable.

It is particularly beneficial if the fire protection element has a coupling section that is held in the slot. The slot is preferably restricted by one of the first support structures opposite the first support edge, especially a second support edge, by means of which a swivelling of the coupling section can be prevented when a tractive force is acting on the fire protection element. A tractive force refers in particular to a force that runs in the closing surface and horizontally.

In other words, the slot is preferably surrounded by two support edges, one support edge of which does not absorb any holding force.

The first support edge is preferably arranged on a first support section of the guide track, especially a support plate, which extends along the closing surface. The second support edge is preferably arranged on a second support section. This second support section extends preferably at least partially along a guide surface, which forms an angle of at least 15° with the closing surface.

According to a preferred embodiment, the opening direction of the slot points away from the closing surface. The opening direction should be understood to mean the direction in which the fire protection element must be pulled in order to move the fire protection element out of the slot with the lowest possible expenditure of energy. It should be noted that it is possible and, according to a preferred embodiment, intended that the slot is covered by a cover plate. This cover plate can be designed in such a way that it guides the fire protection element in the area of the slot so that the fire protection element moves slightly towards the support edge. In this case the opening direction is of course determined without the cover plate.

It is especially beneficial if the fire protection element has a projection that lies on the support edge when a tractive force acting in the closing plane acts on the fire protection element. The tractive force counteracts the holding force. In other words, the holding force is the reaction force to the tractive force. For example, the projection may be composed of a part of the fire protection element. The coupling section is in particular the section of the fire protection element between the projection and the edge of the fire protection element.

It is beneficial if, for every side of the fire resistant material, the holding force is only transferred to the fire resistant material from the support edge. In other words, the holding force is exerted on the left side of the fire protection element from the support edge of the left guide track, and on the right side of the fire protection element the holding force is exerted from the support edge of the right guide track. In terms of the preferred embodiment it is significant that, for each side of the fire protection element, the holding force is only exerted from the support edge of the respective guide track. If the guide tracks become deformed in the event of a fire, the fire protection element can follow this deformation and the sealing effect between the support edge and fire protection element remains intact. If however, as is the case with the prior art, two edges per side exert the holding force, the two edges may warp differently, thereby losing the sealing effect.

According to a preferred embodiment, the guide track is designed to exert the holding force across at least 80% of a height of the guide track. This allows for a secure sealing of the fire protection element to the guide track. In particular, the guide track has a support edge, with the fire protection element lying on the support edge up to at least 70%, in particular at least 80%, preferably 90%, especially preferably to at least 95% of the clearance height of the opening that is sealed by the fire protection element. Alternatively or additionally, the fire protection element lies on the support edge up to at least 90% of its length, this length referring to the length along which the guide track extends. The guide track and the fire resistant material preferably form a smoke-proof connection, thereby fulfilling DIN EN 13501-2 and 3 (as of Aug. 28, 2015).

Alternatively or additionally, the projection is arranged on a holding element, such as a rivet or a button. The projection preferably extends along one lateral edge of the fire protection element. Alternatively it can also be planned for the fire protection element to have a number of projections that are arranged along the lateral edge of the fire protection element.

It is possible and represents a preferred embodiment that the holding element is asymmetrical in relation to the plane along which the fire protection element extends. In particular, the holding element is situated further above one side (front or reverse side) of the fire protection element than above the other side.

It is beneficial if the fire protection element has a lower flexibility in the vicinity of this projection than outside of this vicinity. In this case, the support structure, especially the second support edge, renders it possible to effectively prevent the lateral edge of the fire protection element from making a swivel movement when a tractive force is acting on the fire protection element. This means that the projection remains in contact with the first support edge, which exerts the holding force.

According to a preferred embodiment, the fire or smoke curtain has a light grid generation device for monitoring foreign objects on the closing surface by means of a light grid. As stated above, this light grid generation device can be arranged close to the closing surface because the guide track only needs to exert the holding force on the fire protection element from one side. As is the intention of a preferred embodiment, the light grid generation device can be arranged on the opposite side.

It is beneficial if there is a maximum difference of 4 cm, especially a maximum of 2.5 cm, between the light grid and the closing surface.

It is beneficial if the guide track is made of precisely one, two or three component sheets, as this facilitates production.

According to a preferred embodiment, the fire protection element comprises a cooling material, in particular a layer of cooling material. This cooling material should be particularly understood to mean a material that releases water and/or carbon dioxide above an activation temperature by means of an endothermic reaction. The cooling material may be pure or a mix. For example, the cooling material is at least partially made up of water of crystallisation. The cooling material may contain metal hydrates and/or carbonate and/or a hydroxy compound.

The activation temperature should be particularly understood to mean the lowest temperature at which it occurs that, after one hour at this temperature, over 90% by mass of the cooling material has reacted under heat absorption. It is beneficial if the cooling material reacts above the activation temperature, for example by the emission of water of crystallisation and/or the separation of water. Water has a high evaporation heat, meaning that a lot of heat is absorbed during evaporation. The activation temperature is preferably at least 90° C. and/or a maximum of 250° C.

According to a preferred embodiment, the fire or smoke protection curtain has a piping bar that is arranged to hold the lateral edge of the fire protection element in the guide track. The fire protection element preferably encompasses the piping bar. Alternatively the fire protection element may be fixed to and/or in the piping bar.

It is beneficial if the piping bar has a maximum diameter of 12 millimeters. This diameter should be understood to mean the diameter of a circle that has the same cross-sectional area as the cross-section of the piping bar. The piping bar preferably has an elliptical, especially a circular, cross-section. Alternatively, the cross-section is polygonal, especially in the form of a regular n-angle where n=3, 4, 5, 5, 6, 7, 8, 9, 10, 11, 12, 13, 14, 15 or greater. It has thus far not been possible to use piping bars with such a small diameter as they are not able to exert the necessary holding force in the event of a fire due to warping. Only the special form of the guide track enables the use of such a thin piping bar. Piping bars of guide tracks that comply with the prior art have a diameter of at least 16 millimeters.

The piping bar is preferably arranged in the guide track in such a way that the cross-sectional area of the piping bar lies at least 75%, in particular to at least 85%, preferably completely, on one side of the closing surface. This side of the closing surface is preferably the wall side. The guide track is then preferably designed to be mounted on a wall of a building and the wall side faces the wall. Due to the fact that the piping bar largely lies on one side of the closing surface, the guide rail can be built to be especially flat. The fire protection element must then change its direction so that the holding force is effectively exerted from only one of the sides.

It is beneficial to fix the piping bar at the bottom, i.e. at ground level. It is possible, but not necessary, to fix the piping bar so as to render it rigid. Rather, it is also possible to fix the piping bar with some play.

According to the invention, there is also a building with a wall in which an opening is situated and with a fire or smoke protection curtain according to the invention, which is connected to the building for the sealing of the opening. It is especially beneficial if the guide track is arranged in front of the soffit. This makes the assembly easier and prevents the clear width of the opening from being reduced.

The holding force is preferably exerted on the fire protection element from the wall side.

DESCRIPTION OF THE DRAWINGS

In the following, the invention will be explained in more detail in the attached drawings.

DESCRIPTION

Figure 1:
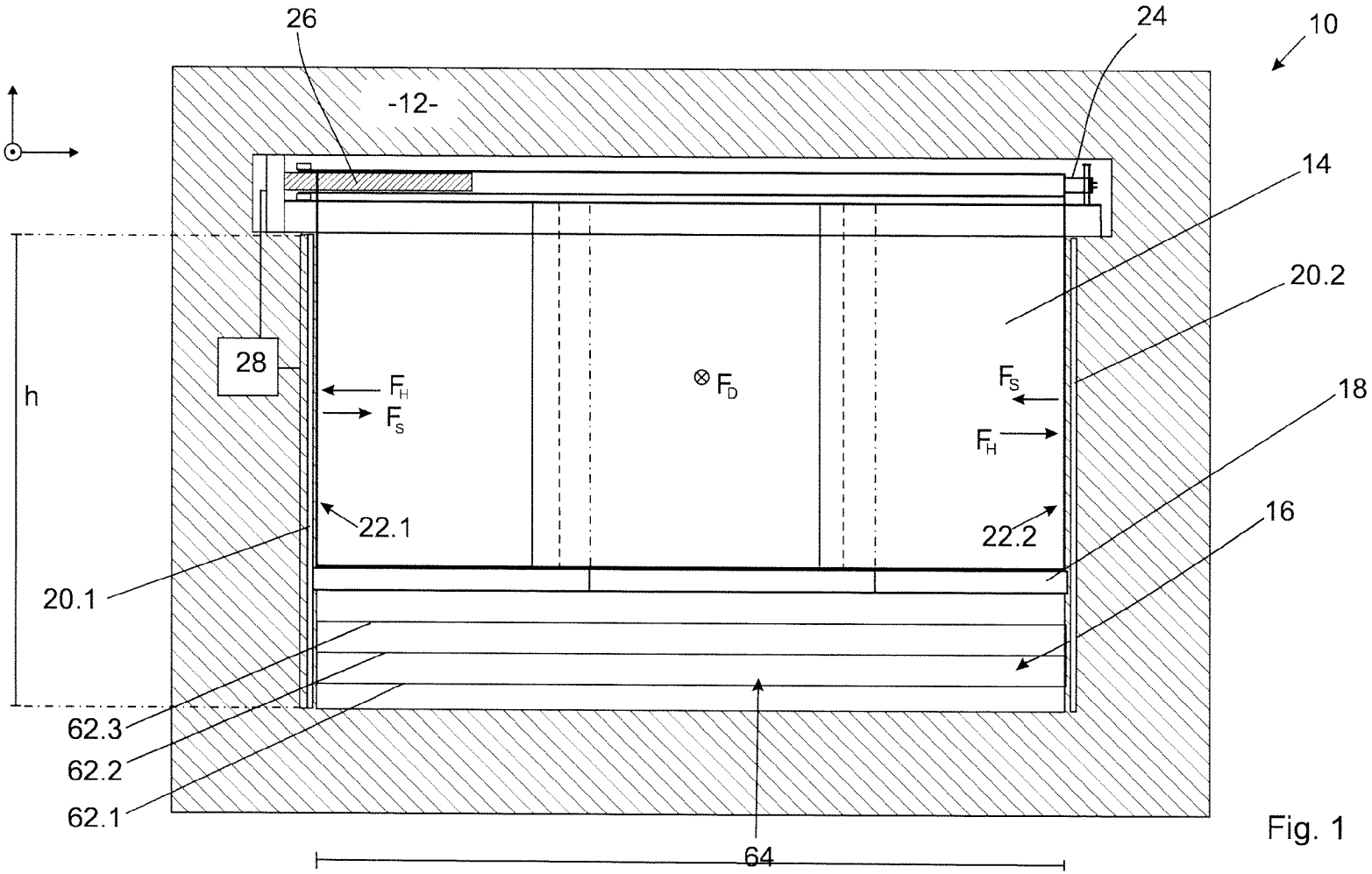
FIG. 1 a schematic overview of a fire or smoke protection curtain according to an embodiment of the invention.

FIG. 1 shows a fire or smoke protection curtain 10 according to the invention that is built into a wall 12 of a building according to the invention and that has a fire protection element 14 which is arranged to seal an opening 16. In the present case, the fire protection element 14 is made up of three webs that are sewn together in the wall 12. The fire or smoke protection curtain 10 also comprises a bottom bar 18.

For the guiding of the fire protection element 14, the fire or smoke protection curtain 10 has a first guide track 20.1 and a second guide track 20.2, which guide the fire protection element 14 on opposite lateral edges 22.1, 22.2. The first guide track 20.1 has a height h, in the present case the second guide track 20.2 has the same height h. In the present case, the height h corresponds to a clearance height of the opening 16. However, it is also possible that the height h is smaller than the clearance height of the opening 16, for example the height h is at least 0.8 times, preferably at least 0.9 times, as high as the clearance height of the opening 16.

If a force $F_D$ acts centrally on the fire protection element 14 it results in a tractive force $F_S$ that acts on the guide tracks 20.1, 20.2. The guide tracks exert a holding force $F_H$ in the opposite direction on the fire protection element 14.

It should be noted that the fire or smoke protection curtain 10 has a winding shaft 24 onto which the fire protection element 14 is rolled up. For the motorised rolling up, a winding shaft motor 26 is arranged in the winding shaft 24, which is supplied with electricity by a control unit 28.

Figure 2A:
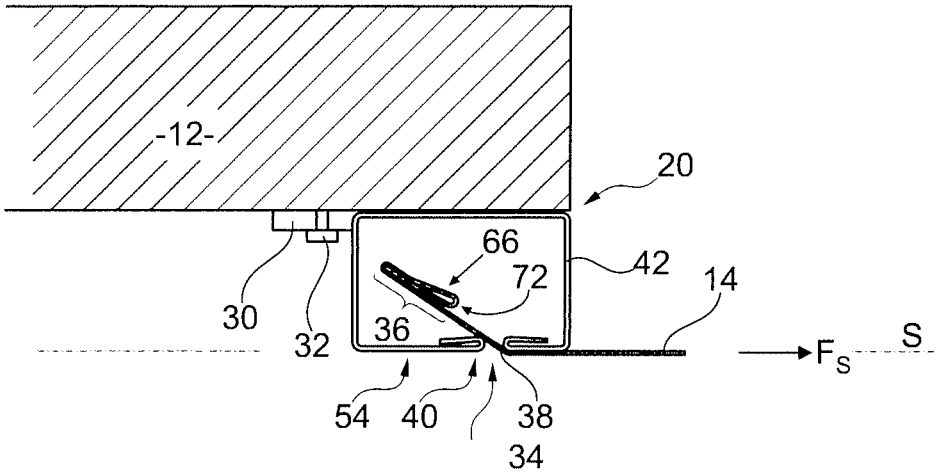
FIG. 2*a* a cross-section through a guide track of a fire or smoke protection curtain according to the invention according to a first embodiment, wherein there is no tractive force acting on the fire protection element.

FIG. 2*a* depicts a guide track 20 that is fixed to the wall 12, for example by means of a fastening clip 30 and at least one screw 32. The guide track 20 has a slot 34 through which a coupling section 36 of fire protection element 14 is threaded. The slot 34 is restricted on one side by a support edge 38. On the opposite side of the support edge 38, the slot 34 is restricted by a support structure 40, which is formed by a second support edge in the present case. Alternatively, the support structure may also be formed by a rod or a wall, none of the edges of which face the slot 34.

The guide track 20 is, which represents a preferred embodiment, made of at least one, in the present case exactly one, plate 42.

If the tractive force $F_S$ acts on the fire protection element 14, the coupling section 36 moves towards to the support edge 38 until the coupling section 36 is caught by the support edge 38. This situation is shown in FIG. 2. The tractive force $F_S$ is absorbed by the support edge 38, which exerts a holding force $F_H$ in the opposite direction on the fire protection element 14.

It should be noted that the fire protection element 14 has a front side 44 and a reverse side 46. The nomenclature with regards to the front side and reverse side is generally arbitrary, but within the scope of the present description the side that is perceived as the reverse side 46 is the one on which the support edge 38 is arranged. If, when in the protection arrangement, the fire protection element 14 extends along a closing surface S in the form of a plane, as intended according to a preferred embodiment, this closing surface S divides the space into two half-spaces 39, 41, wherein the support edge 38 is arranged in the half space 39 that belongs to the reverse side.

It should be noted that the guide track 20 exerts the holding force $F_H$ on the fire protection element 14 from one side only, namely the reverse side 46. In the embodiment according to FIG. 2, the guide track 20 only extends on one side of the closing surface S. However, it should be noted that this is not necessary.

The support structure 40 prevents the coupling section 36 from making a swivelling movement, which is indicated by the arrow B. Due to the fact that this swivel movement B is prevented, the coupling section 36 cannot detach itself from the support edge 38 and remains caught in the guide track 20.

Figure 2B:
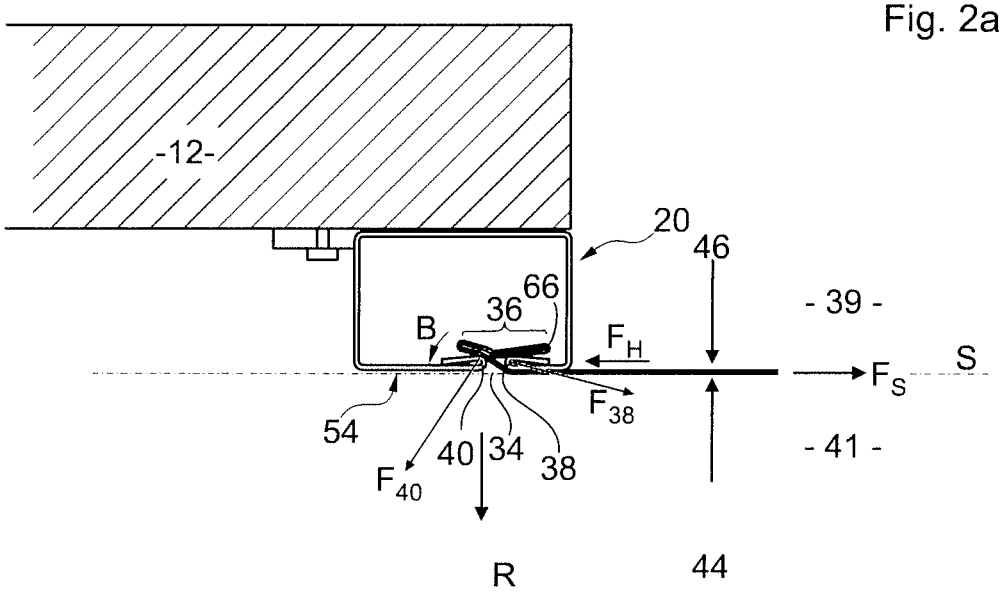
FIG. 2*b* the guide track according to FIG. 2 when a tractive force is acting on it.

FIG. 2*b* shows that, in the present embodiment, the holding force $F_H$ is only absorbed by the support edge 38. There is a force $F_{40}$ acting on the support structure 40, but this only acts predominantly on the closing surface S in the normal direction. The force component of the force $F_{40}$ that is acting on the closing surface S has a sign that is the reverse of that of the holding force $F_H$. In other words, the support structure 40 also does not partially exert the holding force $F_H$.

Figure 3:
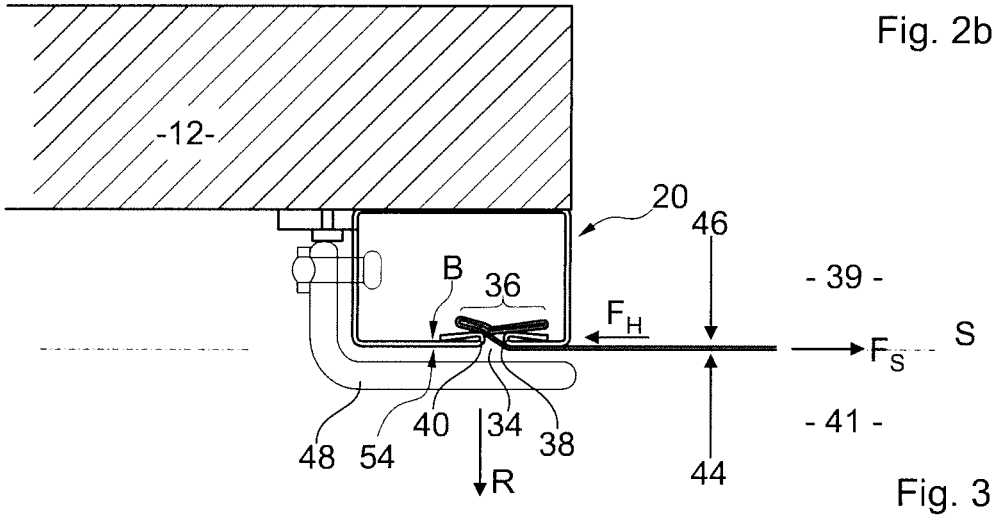
FIG. 3 a cross-section through a guide track of a fire or smoke protection curtain according to the invention according to a second embodiment.

FIG. 3 depicts an alternative embodiment of a guide track 20 of a fire or smoke protection curtain 10 according to the invention, wherein the slot 34 is covered by a cover plate 48. This cover plate guides the fire protection element 14 in the area of the guide track 20 and prevents the fire protection element 14 from being able to move in an opening direction R of the slot 34.

Figure 4:
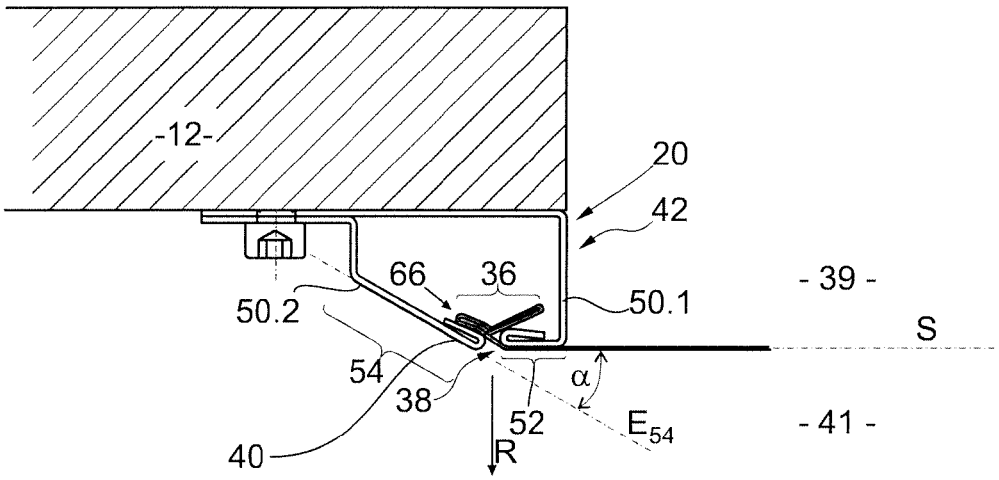
FIG. 4 a cross-section through a guide track of a fire or smoke protection curtain according to the invention according to a third embodiment.

FIG. 4 shows a further embodiment of a guide track 20 for a fire or smoke protection curtain 10 according to the invention, wherein the plate 42 is made up of a first component plate 50.1 and a second component plate 50.2. It should be recognised that the first support edge 38 is arranged on a support section 52 of the plate 42, which extends along the closing surface S. This should be understood to mean that an angle between a correction plane through the support section 52 and the closing surface S is small, for example smaller than 5°. Alternatively it is also possible that the support section 52 extends at an angle to the closing surface S, so that $\alpha>5°$ is applicable, the support section 52 then running in the direction of the reverse side 46.

The second support edge 40 is arranged on a second support section 54 of the plate 42; in the present case on the component plate 50.2. The second support section 54 extends along a guide surface $E_{54}$, which forms a return angle $\alpha$ of at least 15° with the closing surface S. In the present case the return angle is $\alpha=30°$. This enables the coupling section 36 to be held securely on the support edge 38.

In the case shown in FIG. 2*a*, the support structure 40 is formed by a support edge that is arranged on the support section 54. As depicted in FIG. 2*a*, this may run along the closing surface S, which is a closing plane in the present case.

Figure 5:
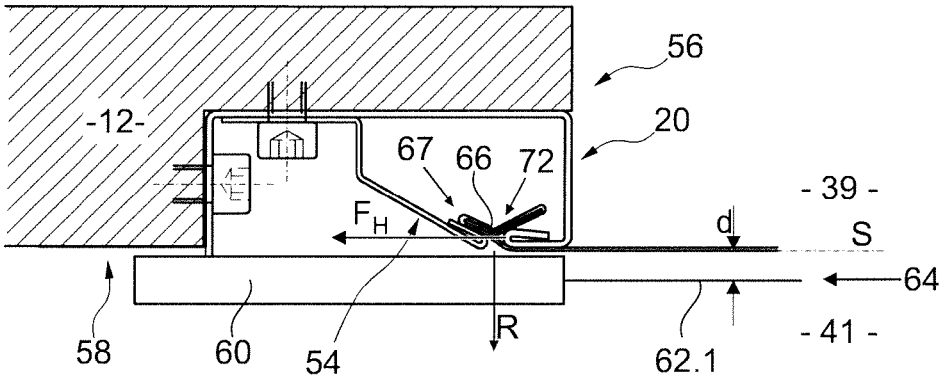
FIG. 5 a cross-section through a guide track of a fire or smoke protection curtain according to the invention, which has a light grid generation device.

FIG. 5 depicts a further embodiment of a guide track 20 for a fire or smoke protection curtain 10 according to the invention that is joined in an edge area between a soffit 56 and the surface of the wall 58, and thereby joined with the wall 12 in front of the soffit 56; in the present case it is screwed together.

FIG. 5 also shows that the fire or smoke protection curtain 10 comprises a light grid generation device 60. This light grid generation device is connected to a control unit 28 and emits several light beams 62.1, 62.2 (see FIG. 1) that form a light grid 64 (see FIG. 1). If one of these light beams 62 is interrupted, the control unit 28 stops the winding shaft motor 26. FIG. 5 depicts that a distance d between the light grid 64 and the closing surface S is small and, in the present case, smaller than 4 cm. The light grid generation device 60 thereby represents a light barrier which monitors a surface for foreign objects.

Figure 6:
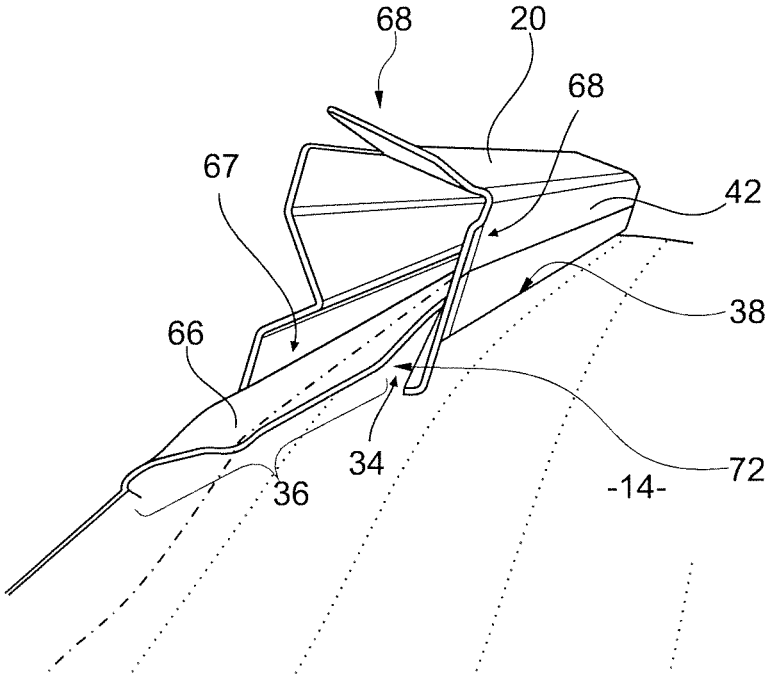
FIG. 6 three-dimensional views of a guide track of a fire or smoke protection curtain according to the invention.

FIG. 6 shows a perspective view of another track 20 of a fire or smoke protection curtain 10 according to the invention. It should be recognised that the coupling section 36 of the fire protection element 14 is formed by a piece of fire resistant material that is turned over and fixed by means of a seam 66. This is how a turnover 67 is created. During operation, the support edge 38 lies flat on the seam 66 and transfers the holding force $F_H$ to the seam 66 and hence to a projection 72 that is formed by the turnover 67.

It should be noted that the plate 42 has an expansion 68 on its top side so that, when the winding shaft 24 is rolling it up (see FIG. 1), the fire protection element 14 can be easily threaded.

Figure 7:
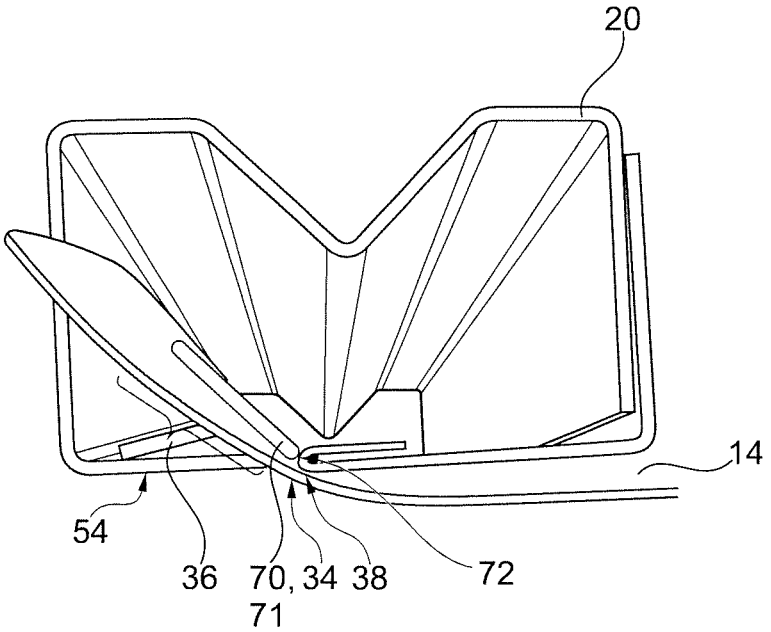
FIG. 7 a perspective view of a fire protection element in a guide track of a fire or smoke protection curtain according to the invention according to a further embodiment according to FIG. 6.

FIG. 7 depicts a further embodiment of a guide track 20 and a fire resistant material 14 of a fire or smoke protection curtain according to the invention. In this embodiment the fire protection element 14 has a holding element 70 in the form of a rivet 71. The projection 72 is arranged on the holding element 70, this projection being prevented from slipping by the support edge 38. The fire protection element 14 consequently has a lower flexibility in the area of the coupling section 36, which is where the projection 72 is situated. The projection 72 interacts with the support edge 38 and the increased stiffness and/or lower flexibility prevents the coupling section 36 from being able to slip out of the slot 34.

Figure 8:
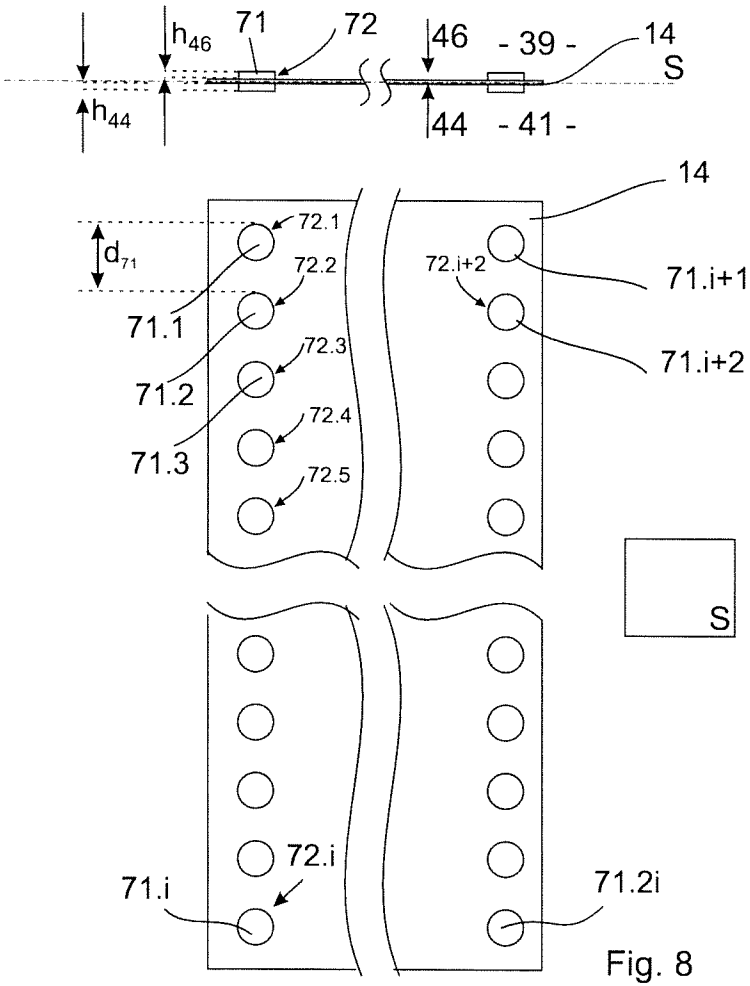
FIG. 8 a schematic view of a fire protection element of the embodiment according to FIG. 6.

FIG. 8 shows that the fire protection element 14 has a number of rivets 71.1, 71.2, . . . , onto each of which a projection 72.1, 72.2, . . . is arranged. After the introduction of the fire protection element 14 into the guide track 20 (see FIG. 7), the projections 72.*n* (n=1, 2, . . . ) lie flat on the support edge 38. The smaller the distance $d_{71}$ between two rivets, the lower the probability that the fire protection element 14 will be able to slip out of the guide track.

In the upper part of the picture it can be recognised that the rivets 71 have a projection height $h_{46}$ in the direction of the reverse side 46. This preferably has a value of between 0.5 mm and 7 mm. It is possible and represents a preferred embodiment that the projection height $h_{44}$ corresponds to the projection height $h_{46}$ in the direction of the front side 44. Alternatively, for example, the projection height $h_{44}$ in the direction of the front side 44 may be smaller than the projection height $h_{46}$. The sum $h_{44}+h_{46}$ of both projection heights preferably has a maximum value of 8 mm, especially 7 mm.

Figure 9:
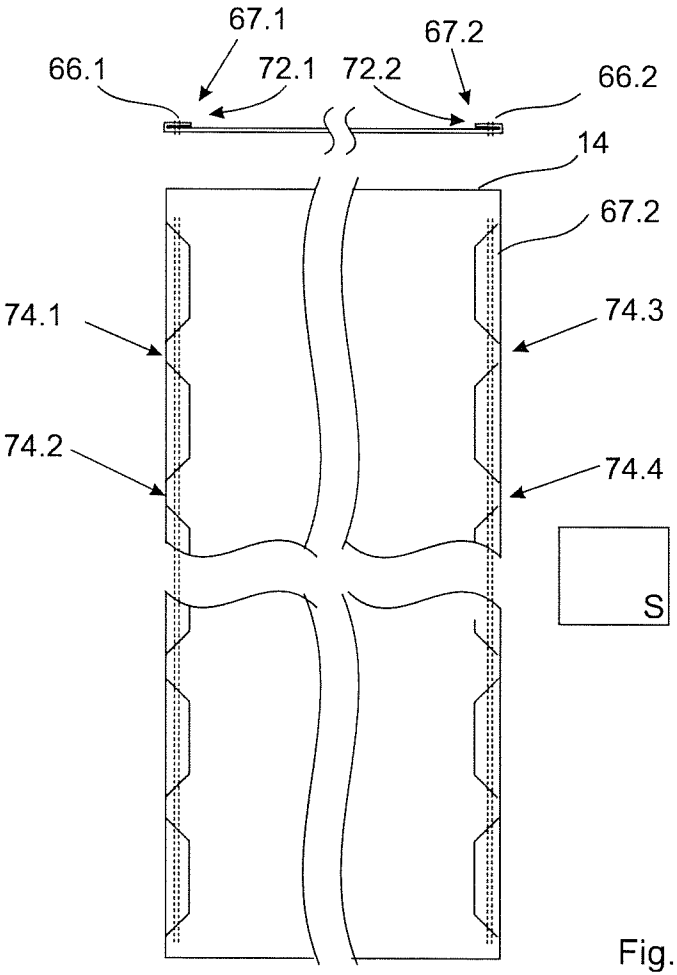
FIG. 9 depicts details of the fire protection element in the embodiment according to FIG. 6.

FIG. 9 depicts the fire protection element 14 in the embodiment according to FIG. 6. It should be noted that the turnover 67 is secured by the seam 66 (references without a numerical suffix refer to all respective corresponding objects). In each case, the projection 72 is arranged on the turnover 67.

In the lower part of the picture it should be recognised that the turnovers 67.1, 67.2 comprise recesses 74.1, 74.2, . . . . These recesses, which represent a preferred embodiment, result in the fire protection element 14 being easier to wind up on a winding shaft 24 (see FIG. 1).

Figure 10B:
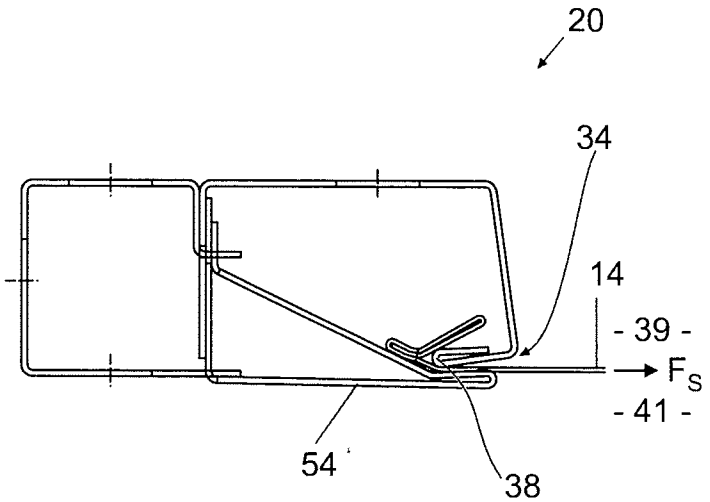
FIGS. 10*a*, 10*b* show a further embodiment according to the invention, wherein in both FIGS. 10*a* and 10*b* the second support section having two sections that run at an angle to one another to increase the maximum holding force.
Figure 10A:
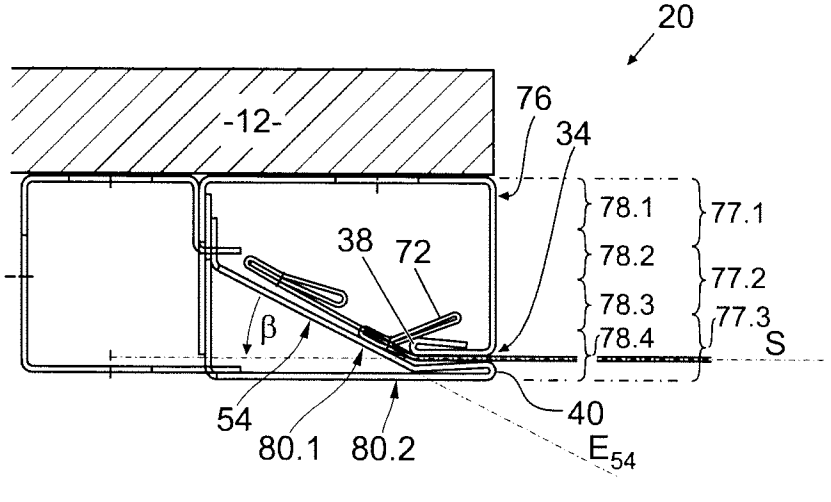

FIG. 10*a* depicts a guide track 20 of a fire or smoke protection curtain according to the invention. It should be noted that the guide track 20 has a front surface 76. The front surface 76 is the surface that can be seen when one looks parallel to the closing surface S from the fire protection element 14 to the guide track 20. The front surface 76 can theoretically be divided into surface terciles 77.1, 77.2, 77.3 and/or surface quartiles 78.1, 78.2, 78.3, 78.4, all surface quartiles being of equal width and together forming the full width of the front surface 76. The first surface tercile 77.1 and the first surface quartile 78.1 are adjacent to the wall 12 to which the guide track 20 is fixed.

It should be noted that the closing surface S runs through the front surface 76 in the outermost lying surface tercile 77.3 of the front surface 76. In the present case, the closing surface S also runs through the front surface 76 in the outermost lying surface quartile 78.4. In other words, the guide track 20 according to the invention functions without the space that would extend beyond the last surface tercile 77.3 with guide tracks according to the prior art. Looking from the wall 12, the guide track is thus considerably thinner behind the closing surface or closing plane S than in front of it.

In the present case, the second support section 54 of the guide track 20 has a first section 80.1 that extends along the guide surface $E_{54}$, and a second section 80.2. The support edge 40 separates the two sections 80.1, 80.2 from one another. The second section 80.2 runs at an angle to the guide surface $E_{54}$. In the present case, an angle β between the guide surface $E_{54}$ and the direction of extension of the second section 80.2 has a value of 15° to 45°, in the present case it is approximately 30°.

Due to the fact that the sections 80.1, 80.2 run at an angle to one another, the second support section 54 yields by an especially small amount. The projection 72 is therefore securely held to the support edge 38.

FIG. 10*b* shows the guide track 20 according to FIG. 10*a*, wherein the tractive force $F_S$ was applied to the fire protection element 14. It should be noted that the slot 34 narrows due to the tractive force $F_S$. The tractive force $F_S$ causes only certain parts of the guide track to move in the direction of the tractive force, those parts being located in the first half-space 39; in the present case that is the plate on which the support edge 38 is arranged. The plate with the support section 54 does not move in the direction of the tractive force, but rather slightly in a direction perpendicular to it.

Figure 10C:
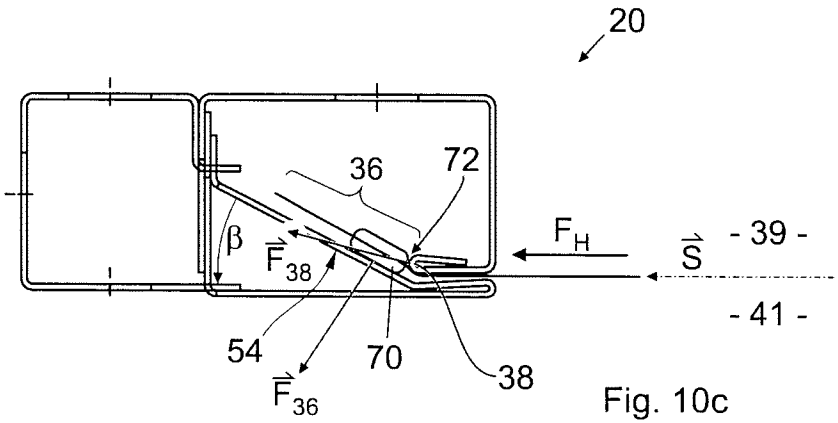
FIG. 10*c* illustrates a further embodiment of the invention, wherein the projection of the fire protection element is formed by rivets.

FIG. 10*c* depicts a further embodiment of a guide track 10 and a fire protection element 14 of a fire or smoke protection curtain 10 according to the invention. It should be recognized that the projection 72 in this embodiment is arranged on a holding element 70.

FIG. 10*c* also depicts the acting forces in detail. The projection 72 presses onto the support edge 38. The support edge 38 exerts the support edge force 38 on the projection 72. The coupling section 36.14 exerts the coupling section force $F_{36}$ on the guide track 20; in the present case, on the second support section 54. The feature that the former force is at least predominantly absorbed by the support edge 38 should especially be understood to mean that $$|\vec{F}_{36}|\cdot\vec{S}\geq k|\vec{F}^{H}|\cdot\vec{S} \quad (1)$$

where k≥ 0.8, k preferably ≥ equals 0.8. In addition, it is preferable if $$\vec{F}_{36}\cdot\vec{S}\geq 0. \quad (2)$$

Here, $\vec{S}$ is the vector that lies in the closing surface S and runs towards the guide track. As a general rule, the vector $\vec{S}$ stands perpendicular on the front surface 76.

Figure 11A:
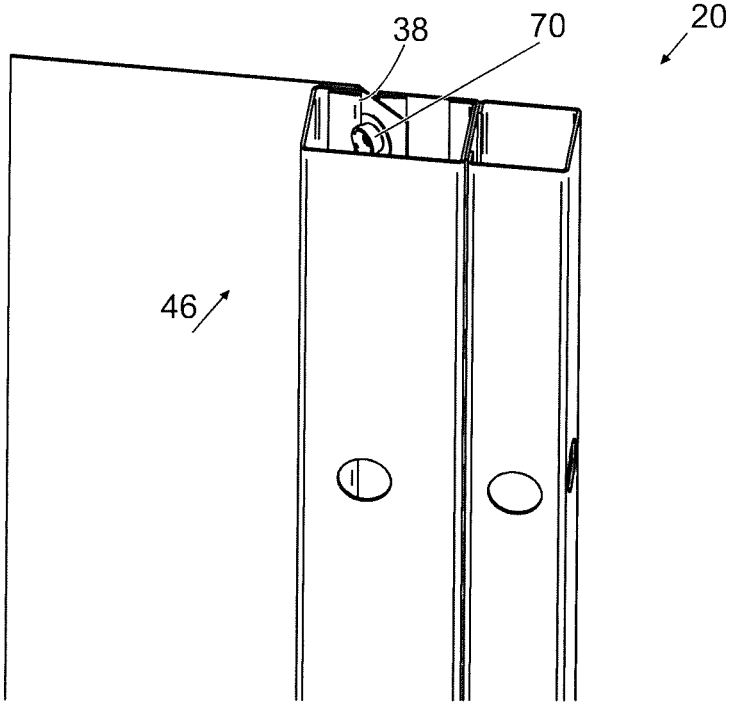
FIG. 11*a* an embodiment wherein the projection, as in FIGS. 6 and 7, is arranged on holding elements.

FIG. 11*a* shows an embodiment wherein the projection, as in FIGS. 6 and 7, is arranged on holding elements 70. Here, the projection height $h_{46}$ (see FIG. 8, upper part of the picture) is greater than the projection height $h_{44}$. This results in the holding element 70 lying flat on the support edge 38 with the part that has the greater projection height.

Figure 11B:
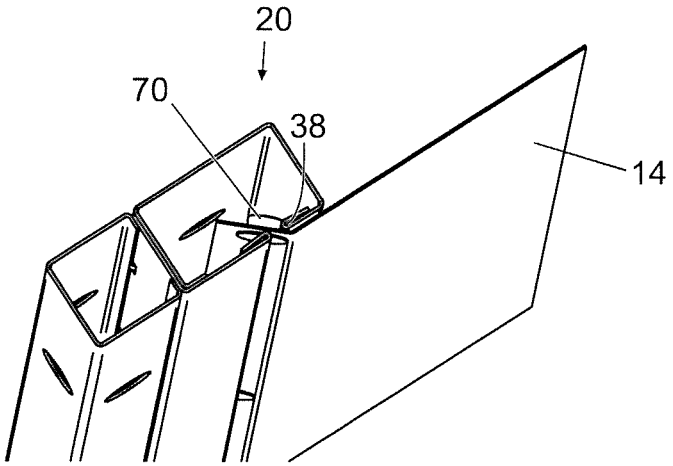
FIG. 11*b* the guide track according to FIG. 11*a* in another perspective view.

FIG. 11*b* depicts the guide track according to FIG. 11*a* in another perspective view.

Figure 12A:
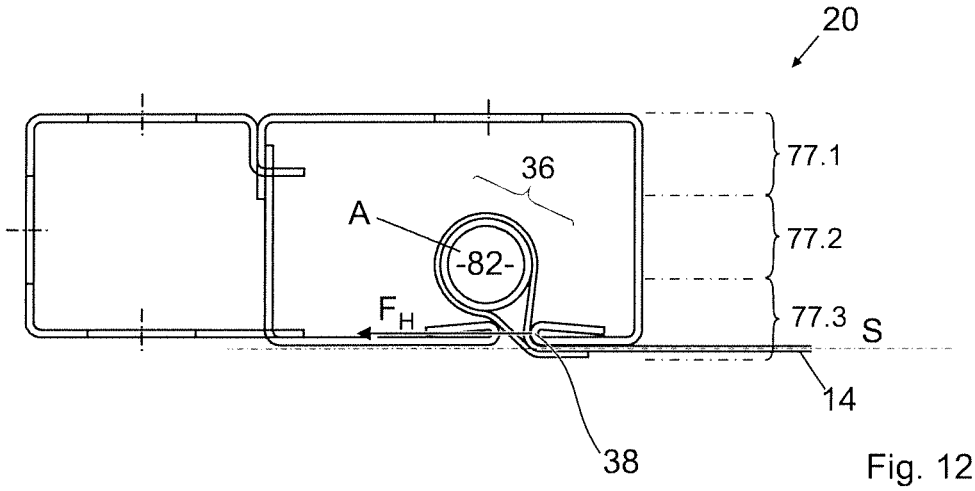
FIGS. 12*a* 12*b*, and 12*c* depict further embodiments according to the invention.

FIG. 12*a* shows a further embodiment of a guide track 20 of a fire or smoke protection curtain according to the invention, which has piping 82 in the form of a piping bar. In its coupling section 36, the fire protection element 14 runs around the piping 82. The holding force $F_H$ is exerted by the support edge 38.

The piping bar 83 holds the lateral edge of the fire protection element 14 in the guide track 20 and is arranged in the guide track 14 in such a way that the cross-sectional area A of the piping bar 83 lies completely on the side of the reverse side 46, i.e. the wall side in this case, of the fire protection element 14. In the present case, the cross-sectional area A also lies entirely on the wall side of the closing surface S, which is a closing plane here.

Figure 12B:
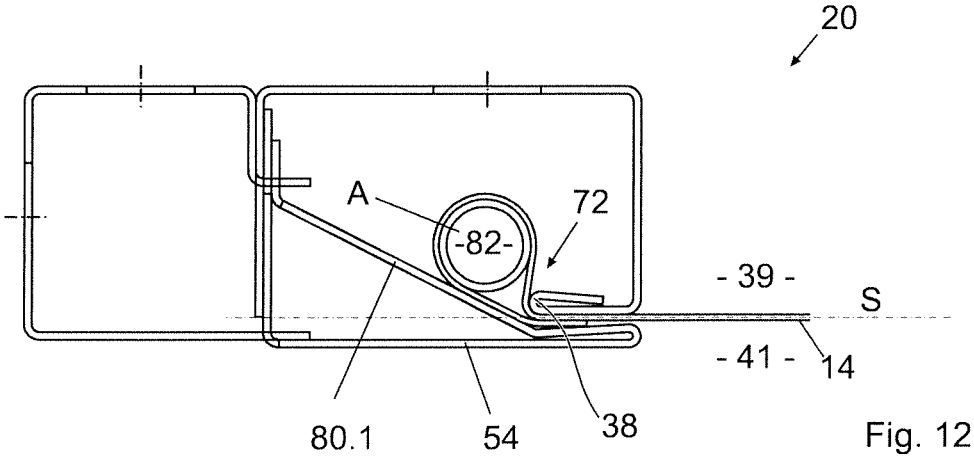

FIG. 12*b* depicts a further embodiment according to the invention which differs from the otherwise structurally identical embodiment according to FIG. 10*c* in that the piping bar 82 results in the formation of the projection 72. A part of the guide track 20 does indeed extend into the second half-space 41, but these components do not absorb the holding force.

Figure 12C:
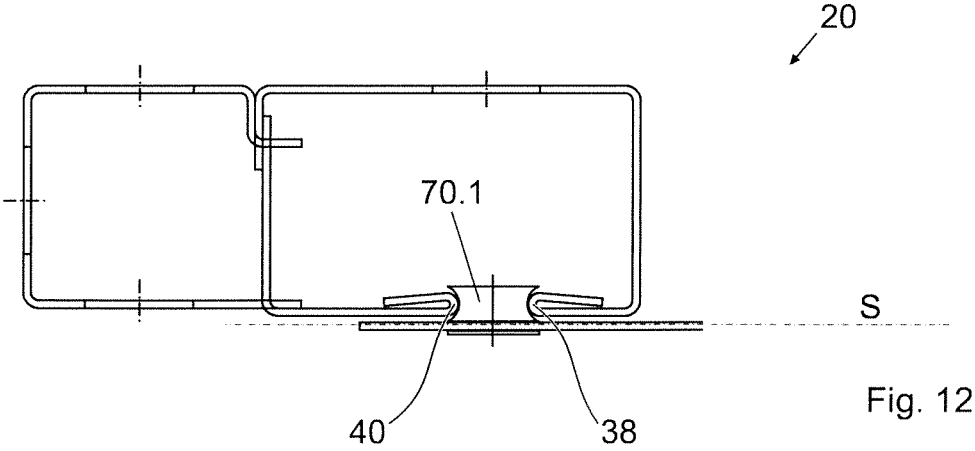

FIG. 12*c* shows a further embodiment with a number of holding elements 70, of which only the holding element 70.1 is labelled. The holding elements have a concave lateral surface which interacts positively with the support edges 38, 40.

| Reference list | |
|---|---|
| 10 | fire or smoke protection curtain |
| 12 | wall |
| 14 | fire protection element |
| 16 | opening |
| 20 | guide track |
| 22 | lateral edge |
| 24 | winding shaft |
| 26 | winding shaft motor |
| 28 | control unit |
| 30 | fastening clip |
| 32 | screw |
| 34 | slot |
| 36 | coupling section |
| 38 | support edge |
| 39 | first half-space |
| 40 | support structure, second support edge |
| 41 | second half-space |
| 42 | plate |
| 44 | front side |
| 46 | reverse side |
| 48 | cover plate |
| 50 | component plate |
| 52 | support section |
| 54 | second support section |
| 56 | soffit |
| 57 | turnover |
| 58 | wall surface |
| 60 | light grid generation device |
| 62 | light beam |

-continued

| Reference list | |
|---|---|
| 64 | light grid |
| 66 | turnover |
| 67 | turnover |
| 68 | expansion |
| 70 | holding element |
| 71 | rivet |
| 72 | projection |
| 74 | recess |
| 76 | front surface |
| 77 | surface tercile |
| 78 | surface quartile |
| 80 | section |
| 82 | piping |
| α | return angle |
| B | swivel movement |
| d | distance |
| $E_{54}$ | guide surface |
| $F_D$ | force |
| $F_H$ | holding force |
| $F_S$ | tractive force |
| $F_{38}$ | support edge force |
| $F_{36}$ | coupling section force |
| h | projection height |
| H | projection height |
| R | opening direction |
| S | closing surface, closing plane |

The invention claimed is:

1. A fire protection curtain, comprising:

a textile fire protection element which comprises a fire resistant material which counteracts the spread of fire, and which has a first side in the form of a front side and a second side in the form of a reverse side, wherein the textile fire protection element is configurable to be put into both a compact bearing arrangement and a protection arrangement in which the textile fire protection element counteracts the spread of a fire, and wherein the textile fire protection element extends along a closing surface (S) when in the protection arrangement, and at least two guide tracks, of which at least one guide track guides the textile fire protection element when the textile fire protection element is in the protection arrangement, wherein the at least one guide track is configured to exert a holding force ($F_H$) that counteracts a bulging of the textile fire protection element, and wherein at least 80% of the holding force ($F_H$) is exerted on the textile fire protection element by a part of the guide track that is arranged on only one of the first and the second sides of the textile fire protection element, wherein the least one guide track comprises a support edge, wherein the textile fire protection element comprises rivets or buttons which abut the support edge, wherein the textile fire protection element has a bend at a position at which the textile fire protection element contacts the support edge, and wherein the textile fire protection element and the at least two guide tracks are configured such that the fire protection curtain is made to withstand a fire for at least 30 minutes according to EN 1634-3.

2. The fire protection curtain according to claim 1, wherein the holding force ($F_H$) acts generally tangentially on the fire protection element.

3. The fire protection curtain according to claim 1 wherein the guide track comprises a slot in which the textile fire protection element is guided when it is in the protection arrangement, and wherein the slot is restricted on one side by a support edge and is arranged in relation to the textile fire protection element in such a way that the holding force ($F_H$) is predominantly absorbed by the support edge.

4. The fire protection curtain according to claim 1 wherein the textile fire protection element has a coupling section that is held in a slot, and wherein the slot is restricted by one of a plurality of first support structures opposite a first support edge, wherein a swivelling of the coupling section is prevented when a tractive force ($F_S$) is acting on the fire protection element.

5. The fire protection curtain of claim 4 wherein the first support edge is a first support edge, wherein the first support edge is arranged on a support section which extends along the closing surface (S), and wherein said one of the first support structures opposite the first support edge is a second support edge wherein the second support edge is arranged on a second support section which extends at least partially along a guide surface which forms a return angle (α) of at least 15° with the closing surface (S).

6. The fire protection curtain according to claim 4 wherein an opening direction (R) of the slot points away from the closing surface (S), and the textile fire protection element is moveable out of the slot in the opening direction (R).

7. The fire protection curtain according to claim 3 wherein the textile fire protection element has a projection that lies flat on the support edge if a tractive force ($F_S$) acting in the closing surface (S) acts on the fire resistant material.

8. The fire protection curtain according to claim 1 wherein at least 90% of a length of the textile fire protection element lies on the support edge in a protection arrangement, and wherein the support edge exerts at least 90% of the holding force ($F_H$), thereby forming a smoke-proof seal between the at least one guide track and the textile fire protection element.

9. The fire protection curtain according to claim 1 wherein the at least one guide track has a front surface, and wherein the closing surface (S) runs through the front surface in an outermost lying surface tercile.

10. The fire protection curtain according to claim 9 wherein the outermost lying surface tercile is a surface quartile of the front surface.

11. The fire protection curtain according to claim 1, wherein the part of the guide track exerting at least 80% of the holding force ($F_H$) is arranged on a first support section, and wherein the fire protection curtain further comprises a second support section comprised of a first section and a second section, wherein the first section extends along a guide surface and the second section runs at an angle to the guide surface.

12. The fire protection curtain according to claim 1 further comprising at least one piping bar that is arranged to hold a lateral edge of the textile fire protection element in the at least one guide track, wherein the piping bar is arranged in the at least one guide track so that a cross-section surface (A) of the piping bar lies up to 85% on one side of the closing surface (S).

13. The fire protection curtain of claim 12 wherein the cross-section surface (A) lies completely on one side of the closing surface.

14. The fire protection curtain according to claim 1 wherein the at least one guide track is designed to exert the holding force ($F_H$) across at least 80% of a height (h) of the at least one guide track.

15. The fire protection curtain according to claim 1 further comprising a light grid generation device for the monitoring of the closing surface (S) for foreign objects using a light grid, wherein a distance (d) between the light grid and the closing surface (S) is a maximum of 4 centimeters.

16. The fire protection curtain according to claim 15 wherein the distance (d) is a maximum of 2.5 centimeters.

17. A building, comprising:

a wall in which an opening is arranged; and a fire protection curtain designed to seal the opening, wherein the fire protection curtain comprises a textile fire protection element which comprises a fire resistant material which counteracts the spread of fire, and which has a first side in the form of a front side and a second side in the form of a reverse side, wherein the textile fire protection element is configurable to be put into both a compact bearing arrangement and a protection arrangement in which the textile fire protection element counteracts the spread of a fire through the opening, and wherein the textile fire protection element extends along a closing surface (S) when in the protection arrangement, and at least two guide tracks, of which at least one guide track which guides the textile fire protection element when the textile fire protection element is in the protection arrangement, wherein the at least one guide track is configured to exert a holding force ($F_H$) that counteracts a bulging of the textile fire protection element, and wherein at least 80% of the holding force ($F_H$) is exerted on the textile fire protection element by a part of the guide track that is arranged on only one of the first and the second sides of the textile fire protection element, wherein the at least one guide track is arranged in front of the opening in a soffit on the wall, wherein the least one guide track comprises a support edge, wherein the textile fire protection element comprises rivets or buttons which abut the support edge, wherein the textile fire protection element has a bend at a position at which the textile fire protection element contacts the support edge, and wherein the textile fire protection element and the at least two guide tracks are configured such that the fire protection curtain is made to withstand a fire for at least 30 minutes according to EN 1634-3.

18. A fire protection curtain, comprising:

a textile fire protection element which comprises a fire resistant material which counteracts the spread of fire, and which has a first side in the form of a front side and a second side in the form of a reverse side, wherein the textile fire protection element is configurable to be put into both a compact bearing arrangement and a protection arrangement in which the textile fire protection element counteracts the spread of a fire, and wherein the textile fire protection element extends along a closing surface (S) when in the protection arrangement, and at least two guide tracks, of which at least one guide track guides the textile fire protection element when the textile fire protection element is in the protection arrangement, wherein the at least one guide track is configured to exert a holding force ($F_H$) that counteracts a bulging of the textile fire protection element, and wherein at least 80% of the holding force ($F_H$) is exerted on the textile fire protection element by a part of the guide track that is arranged on only one of the first and the second sides of the textile fire protection element, wherein the least one guide track comprises a support edge, wherein the textile fire protection element comprises rivets or buttons which abut the support edge, wherein the textile fire protection element has a bend at a position at which the textile fire protection element contacts the support edge, and wherein the fire resistant material is according to DIN EN 13501-2 and 3.

19. A building, comprising:

a wall in which an opening is arranged; and a fire protection curtain designed to seal the opening, wherein the fire protection curtain comprises a textile fire protection element which comprises a fire resistant material which counteracts the spread of fire, and which has a first side in the form of a front side and a second side in the form of a reverse side, wherein the textile fire protection element is configurable to be put into both a compact bearing arrangement and a protection arrangement in which the textile fire protection element counteracts the spread of a fire through the opening, and wherein the textile fire protection element extends along a closing surface (S) when in the protection arrangement, and at least two guide tracks, of which at least one guide track which guides the textile fire protection element when the textile fire protection element is in the protection arrangement, wherein the at least one guide track is configured to exert a holding force ($F_H$) that counteracts a bulging of the textile fire protection element, and wherein at least 80% of the holding force ($F_H$) is exerted on the textile fire protection element by a part of the guide track that is arranged on only one of the first and the second sides of the textile fire protection element, wherein the at least one guide track is arranged in front of the opening in a soffit on the wall, wherein the least one guide track comprises a support edge, wherein the textile fire protection element comprises rivets or buttons which abut the support edge, wherein the textile fire protection element has a bend at a position at which the textile fire protection element contacts the support edge, and wherein the fire resistant material is according to DIN EN 13501-2 and 3.

* * * * *